US005497989A

United States Patent [19]

Ritchie et al.

[11] Patent Number: 5,497,989

[45] Date of Patent: Mar. 12, 1996

[54] BALL TROUGH FOR PINBALL GAMES

[75] Inventors: Mark D. Ritchie, Carol Stream; Ming D. Zhang, Des Plaines; Robert S. Morrison, Elgin, all of Ill.

[73] Assignee: CAPCOM Coin-Op, Inc., Arlington Heights, Ill.

[21] Appl. No.: 387,109

[22] Filed: Feb. 10, 1995

[51] Int. Cl.[6] ..... A63F 7/34

[52] U.S. Cl. ..... 273/118 R; 273/119 R; 273/121 R

[58] Field of Search ..... 273/118, 119, 273/121

[56] References Cited

U.S. PATENT DOCUMENTS 2,019,150 10/1935 Maitland .
5,120,059 6/1992 Oursler ..... 273/118 D X
5,322,283 6/1994 Ritchie et al. .
5,358,240 10/1994 Lawlor et al. ..... 273/118 A X
5,358,243 10/1994 Eddy et al. .
5,364,096 11/1994 Cebula et al. .

*Primary Examiner*—Raleigh W. Chiu
*Attorney, Agent, or Firm*—Robert E. Browne; Gary R. Jarosik

[57] ABSTRACT

In a pinball machine a ball trough is provided for moving the ball between the drain hole and the shooter lane. The ball trough comprises a channel fixed to the playfield and has a first end adjacent the drain hole and a second end proximate to the shooter lane. A rotatable carrier is movable between a first position and a second position for carrying the ball from the channel to the shooter lane and has a load opening, an exit opening, and a passage therebetwen. The load opening is positioned adjacent to the second end when the carrier is disposed in the first position and the exit opening is disposed adjacent to the shooter lane when the carrier is disposed in the second position. The passage may have an arcuate surface on which the ball will ride as the carrier approaches the second position for urging the ball out the exit opening.

5 Claims, 3 Drawing Sheets

BALL TROUGH FOR PINBALL GAMES

BACKGROUND OF THE INVENTION

This invention relates generally to pinball games and, more particularly, relates to an improved ball trough for such games.

Pinball games typically consist of an inclined playfield supporting a plurality of play features such as targets, bumpers, and the like. Disposed on the playfield are a pair of flippers which are used to direct a ball at selected game features for scoring points. Play usually begins with the ball positioned in the shooter lane where the player manipulates a spring loaded plunger to propel the ball onto the playfield. Play continues until the ball drains from the playfield via a drain hole which is normally located behind the flippers to capture balls which have been misplayed. Located in the playfield, out of sight of the player, is a ball trough which extends from the drain hole to the shooter lane for transporting balls therebetween.

An example of a prior art ball trough may be found in U.S. Pat. No. 5,358,243 to Eddy et al. which is herewith incorporated by reference in its entirety. The ball trough disclosed therein consists of a generally U-shaped channel that is mounted to the underside of the playfield and extends between the drain hole and the shooter lane. The bottom surface of the channel is inclined relative to the horizontal such that a ball entering the drain hole will roll under the force of gravity toward the shooter lane. When activated, a solenoid plunger will kick the ball adjacent the shooter lane up through an aperature in the playfield and into the shooter lane. A series of optical switches are also mounted on the channel and arranged such that each switch will detect the presence or absence of each ball in the queue. In this embodiment, the kicker must supply enough force to the ball to elevate the ball back to the level of the playfield.

While this embodiment is useful in achieving its purpose, it has been noticed that the procedure used to elevate the ball into the shooter lane generates a vibrational force large enough to shake the entire structure. These vibrational forces have been known to causes some of the optical switches associated with the channel to become displaced. As mentioned, these optical switches are used by the microprocessor to asses playing conditions whereby any failure or misalignment of the optical switches will cause a resulting failure in the game control. Therefore, a need exists for providing an improved ball trough capable of moving the ball into the shooter lane without the jolting associated with currently employed kicker mechanisms.

As a result of these exising needs, it is an object of the present invention to provide an improved lifting mechanism whereby balls may be smoothly carried from the ball trough to the shooter lane.

SUMMARY OF THE INVENTION

In accordance with the present invention an amusement game is provided, comprising a playfield supporting a movable game piece, a plurality of play features, a shooter lane for putting the game piece in play, and a drain for allowing the game piece to exit the playfield. A trough links the drain to the shooter lane and comprises a channel fixed to the playfield and having a first end adjacent the drain and a second end proximate to the shooter lane whereby the game piece will be caused to move from the first end toward the second end if the game piece enters the drain and a carrier movable between the second end and the shooter lane for carrying the game piece from the second end into the shooter lane.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiments shown in the following drawings in which.

DETAILED DESCRIPTION

Figure 1:
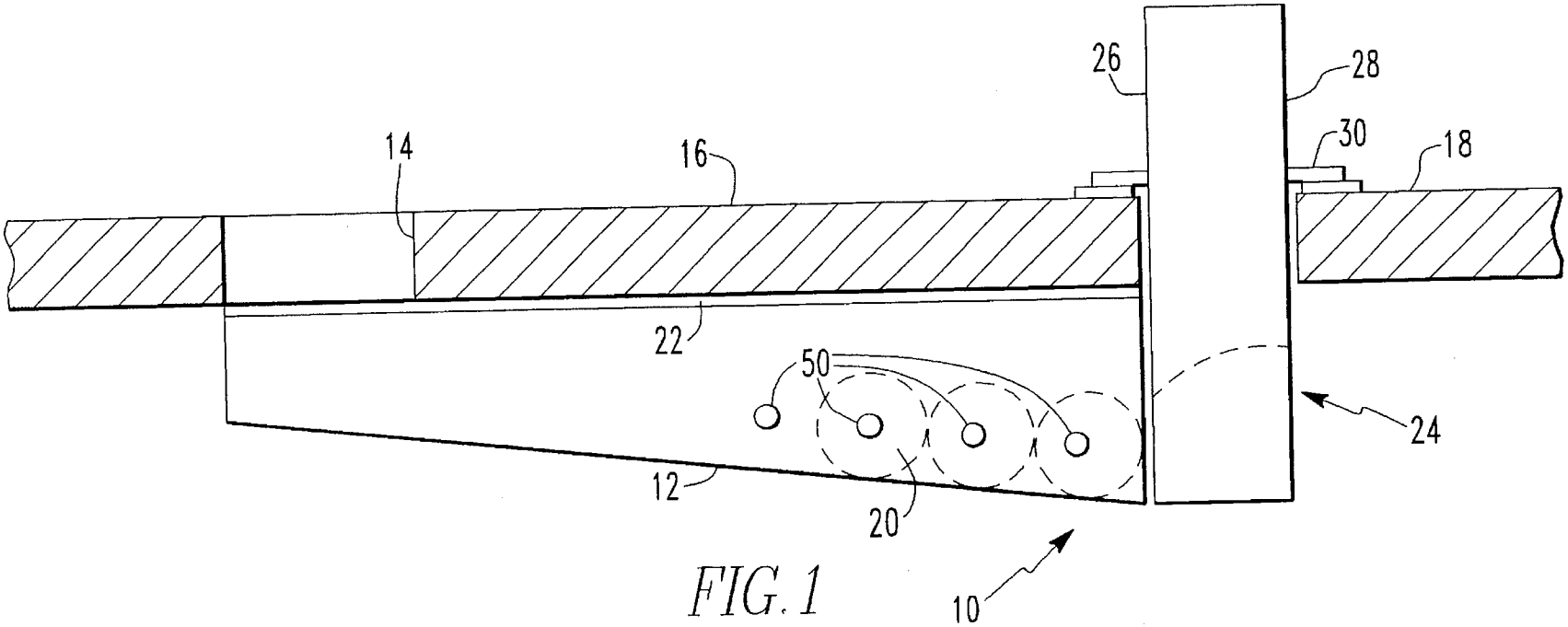
FIG. 1 shows a side view of the ball trough for use in a pinball game which is the subject of the present invention.

Referring now to the figures, wherein like reference numerals refer to like elements, there is generally shown in FIG. 1 a ball trough 10. Specifically, ball trough 10 consists of an elongated, substantially U-shaped channel 12 extending between the drain hole 14 in playfield 16 and the shooter lane 18. Each side of the channel 12 extends perpendicularly from playfield 16 where the distance between each side is approximately equal to the diameter of a pinball 20 whereby each pinball 20 disposed in the channel 12 will be substantially centered therein. The bottom of the channel 12 is inclined relative to horizontal such that a pinball 20 dropping into the drain hole 14 will roll by force of gravity in the direction of the shooter lane 18. To mount the channel 12 to the underside of the playfield 16 the channel 12 is equiped with flanges 22 extending laterally from each side thereof. The flanges 22 are fixed to the underside of the playfield 16 by any suitable fastening device.

Figure 4:
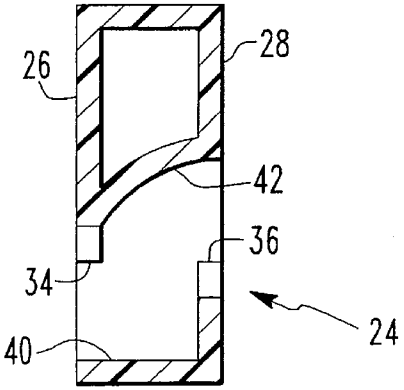
FIG. 4 is a sectional view of the carrier illustrated in FIGS. 2 and 3 along line IV—IV in FIG. 3.
Figure 3:
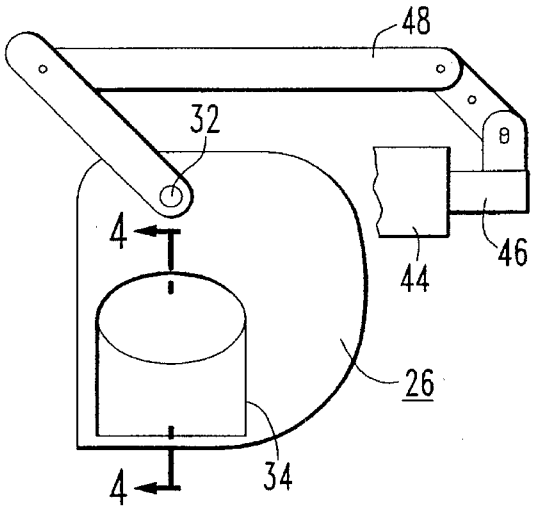
FIG. 3 is a side view of the carrier illustrated in FIG. 2.
Figure 2:
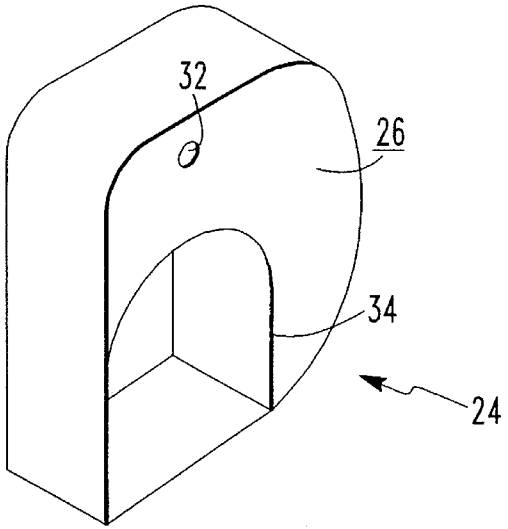
FIG. 2 shows a perspective view of a carrier which is part of the ball trough illustrated in FIG. 1.

To elevate a pinball 20 from the channel 12 to the shooter lane 18 a carrier 24 is provided and is best viewed in FIGS. 2–4. The carrier 24 is preferably constructed from plastic to reduce weight and comprises a load side 26 positioned adjacent to channel 12 and an exit side 28 positioned adjacent to shooter lane 18. The carrier 24 is further rotatably mounted to playfield 16 by a pivot pin 30 which passes through a pivot hole 32 in carrier 24. The width of the carrier 24 between sides 26,28 is approximately equal to the diameter of a pinball 20. Positioned in the load side 26 is a load opening 34 and positioned in the exit side 28 is an exit opening 36 where the load opening 34 and the exit opening 28 are connected by a channel 38. Channel 38 has a floor 40 and a ceiling 42 where the ceiling 42 is preferably curved from the top of the load opening 34 to the top of the exit opening 36 as the exit opening 36 is positioned higher on exit side 28 relative to load opening 34 on load side 26.

To cause the carrier 24 to rotate about pivot pin 30 a conventional solenoid, motor, or the like, 44 is provided. In the illustrated embodiment, solenoid 44 is equiped with a retractable plunger 46 which is spring biased in the extended position. Connecting the plunger 44 to the carrier 24 is a link 48. Specifically, the solenoid 44 and the carrier 24 are linked such that the load opening 34 is positioned adjacent the exit of the channel 12 when the plunger 46 is fully extended and the exit opening 36 is positioned above the shooter lane 18 when the plunger 44 is fully retracted. The rotational movement of the carrier 24 between these two extreme positions is approximately 110 degrees. Those skilled in the art will appreciate that a conventional, bi-directional motor may be employed to accomplish the same movement achieved with the illustrated solenoid.

Disposed in each side of channel 12 are spaced aperatures 50 such that the aperatures on each side are aligned. As is conventional, one side of channel 12 is provided with optical emitters while the opposite side of channel 12 is provided with optical receptors whereby optical switches are created therebetween through aperatures 50. The optical switches are spaced along channel 12 such that each switch detects the presence or absence of a pinball 20 in the pinball queue. As is known, the signals from the optical switches are received by a game microprocessor for allowing the microprocessor to determine whether one or more balls are lost or trapped on the playfield.

In operation, the ball trough 10 will contain as many pinballs as is necessary to allow the game to function. The pinball leading the queue will be positioned within load opening 34 of carrier 24 owing to the force of gravity acting thereupon as the ball trough 10 awaits a load command. Owing to the width of the carrier 24 only one pinball may be disposed in load opening 34 at any one time. Upon the receipt of a load command, the solenoid 44 will cause the carrier 24 to start to rotate carrying the pinball therealong. The pinballs remaining in the channel 12 will not move as the new ball leading the queue will make contact with load side 26 while the carrier 24 rotates. Once the carrier 24 reaches the unload position, corresponding to the plunger 46 being fully retracted, exit opening 36 will have cleared the playfield and the ball is free to be urged forward into the shooter lane 18 by the curvature of ceiling 42 upon which the ball now rests owing to the rotation. Once the ball has unloaded, the solenoid 44 is deactivated and the carrier 24 returns to load a new ball in channel 38.

Figure 5:
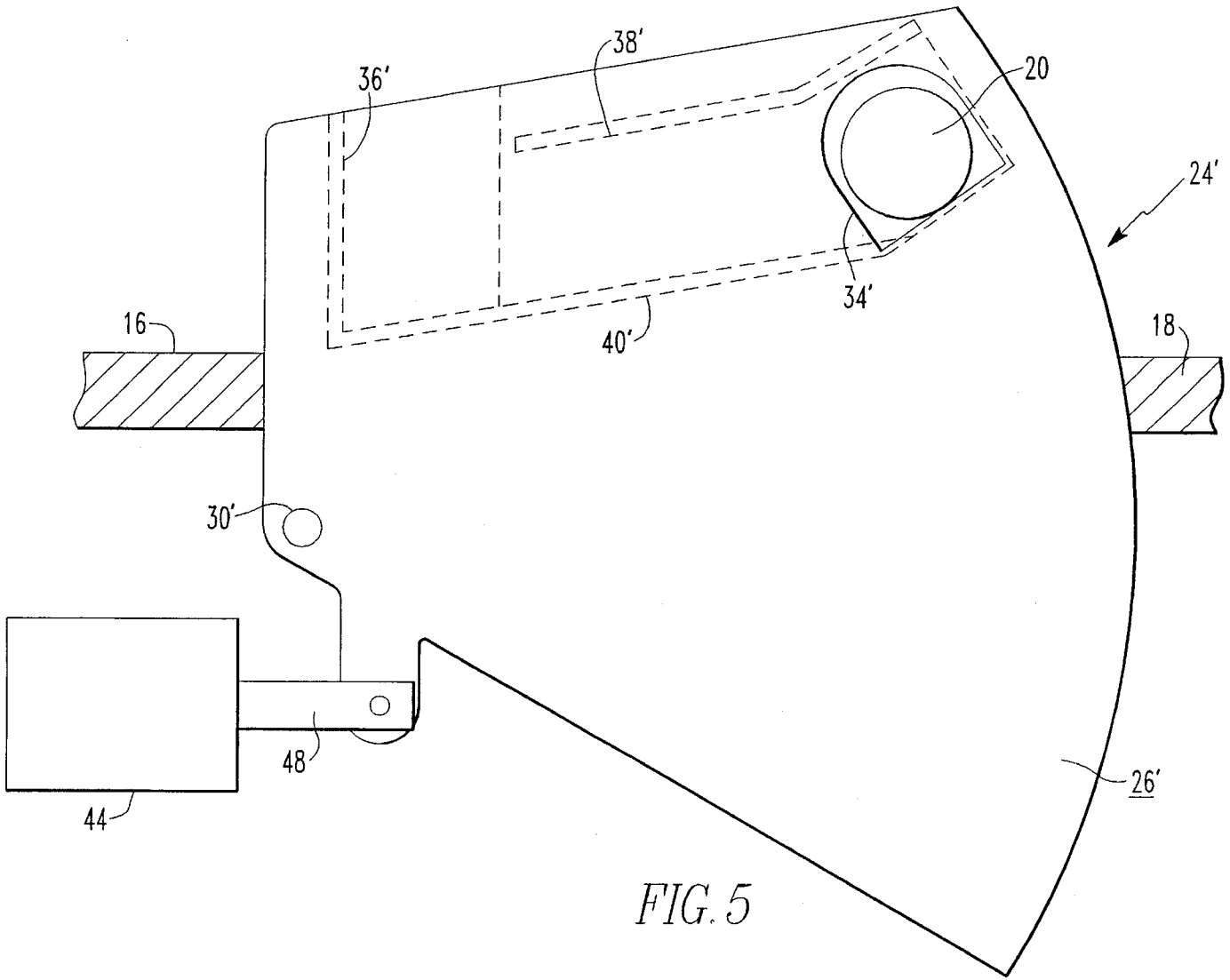
FIG. 5 is a side view of another embodiment of a carrier which may be employed in the ball trough design illustrated in FIG. 1.

In the second embodiment, illustrated in FIG. 5, the carrier 24' is again preferably constructed from plastic to reduce weight and comprises a load side 26' positioned adjacent to the channel and an exit side positioned adjacent to the shooter lane. The carrier 24' is rotatably mounted to the playfield 16 by a pivot pin 30'. The width of carrier 24' is again approximately equal to the diameter of a pinball 20. Positioned in the load side 26' is a load opening 34' and positioned on the exit side is a exit opening 36'. Connecting the two openings 34',36' is channel 38'.

To cause the carrier 24' to rotate about pivot pin 30' a solenoid, motor, or the like, 44 may be used. In the illustrated embodiment, solenoid 44 is equiped with a plunger 48 which is linked to the carrier 26'. The solenoid 44 used may be normally retracted where activation will cause the plunger to extend or the solenoid 44 may be normally extended where activation will cause the plunger to retract so long as the carrier 24' is linked such that the proper positioning is achieved. As before, it is desired that the carrier be normally positioned with load opening 34' positioned adjacent the channel and movable to a position wherein exit opening 36' is positioned above the shooter lane 18. In the illustrated embodiment, the rotational movement of the carrier 24' between the extreme positions is approximately 60 degrees.

In operation, the pinball leading the queue will be positioned within load opening 34' of carrier 24' owing to the force of gravity acting thereupon. Owing to the width of carrier 24' only one pinball may be disposed in load opening 34' at any one time. Upon the receipt of a load command, the solenoid 44 or motor will cause the carrier 24' to rotate carrying the pinball therealong. The pinballs remaining in channel 12 will not move as they will contact the load side surface as carrier 24' rotates. As the carrier 24' rotates the pinball will be caused to travel down channel 38' to exit opening 36' where the pinball will exit the carrier 24' to enter the shooter lane 18. The carrier may be disposed at a slight angle whereby the pinball will rest against the interior of the exit side which helps to prevent the ball from escaping from the load opening during movement. Once the pinball has been removed from the carrier, the solenoid or motor causes the carrier 24' to move to its normal, rest position at which time another ball may load into load opening 34'.

It should be apparent from the preceding description that this invention has among other advantages, the advantage of eliminating the shocks associated with conventional kicker load mechanisms.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

We claim:

1. A pinball game, comprising:

an inclined playfield supporting a rolling ball, a plurality of play features, a shooter lane for putting a ball in play and a drain hole allowing said ball to exit said playfield; and a ball trough;

wherein said ball trough comprises:

a channel fixed to said playfield and having a first end adjacent said drain hole and a second end proximate to said shooter lane, said channel having a surface for supporting a row of balls thereon and positioned to cause said balls to roll from said first end to said second end by force of gravity; and a rotatable carrier movable between a first position and a second position for carrying one of said balls from said channel to said shooter lane, said rotatable carrier having a load opening, an exit opening, and a passage therebetwen wherein said load opening is positioned adjacent said second end when said carrier is disposed in said first position and wherein said exit opening is disposed adjacent said shooter lane when said carrier is disposed in said second position.

2. The pinball game as recited in claim 1, wherein said passage has an arcuate surface on which said one of said balls will ride as said carrier approaches said second position for urging said one of said balls out said exit opening.

3. The pinball game as recited in claim 1, further comprising a solenoid linked to said carrier for moving said carrier between said first and second positions.

4. The pinball game as recited in claim 1, further comprising a motor linked to said carrier for moving said carrier between said first and second positions.

5. A pinball game, comprising:

an inclined playfield supporting a rolling ball, a plurality of play features, a shooter lane for putting a ball in play, and a drain hole for allowing said ball to exit said playfield; and a ball trough;

wherein said ball trough comprises:

a guide having a first end positioned adjacent to said drain hole and a second end positioned proximate to said shooter lane, said guide having a surface for supporting a row of balls thereon and for allowing said balls to move from said first end to said second end; and a rotatable carrier movable between a first position and a second position for carrying one of said balls from said guide to said shooter lane, said rotatable carrier having a load opening and an exit opening, and a passage therebetween wherein said load opening is positioned adjacent said second end when said carrier is disposed in said first position and wherein said exit opening is positioned adjacent said shooter lane when said carrier is disposed in said second position.

* * * * *